US010239674B1

(12) United States Patent
Patton et al.

(10) Patent No.: US 10,239,674 B1
(45) Date of Patent: Mar. 26, 2019

(54) CHILD-RESISTANT CONTAINER

(71) Applicant: Kush Bottles, Inc., Santa Ana, CA (US)

(72) Inventors: Douglas Patton, Irvine, CA (US); Gary Bordenkircher, Lake Forest, CA (US); Jeffrey Thompson, Santa Ana, CA (US); Heather Patton, Irvine, CA (US); Mathew Astengo, Santa Ana, CA (US); Ben Wu, Santa Ana, CA (US)

(73) Assignee: Kush Bottles, Inc., Garden Grove, CA (US)

( * ) Notice: Subject to any disclaimer, the term of this patent is extended or adjusted under 35 U.S.C. 154(b) by 0 days.

(21) Appl. No.: 16/000,848

(22) Filed: Jun. 5, 2018

Related U.S. Application Data

(60) Provisional application No. 62/650,980, filed on Mar. 30, 2018, provisional application No. 62/586,098, filed on Nov. 14, 2017.

(51) Int. Cl.
*B65D 50/06* (2006.01)
*B65D 55/02* (2006.01)

(52) U.S. Cl.
CPC ..... *B65D 50/061* (2013.01); *B65D 55/02* (2013.01); *B65D 2215/04* (2013.01)

(58) Field of Classification Search
CPC ... B65D 50/061; B65D 55/02; B65D 2215/04
USPC ..... 220/293, 298, 300; 215/222, 332
See application file for complete search history.

(56) References Cited

U.S. PATENT DOCUMENTS 3,667,636 A * 6/1972 Landen ..... B65D 41/065 215/214
3,831,802 A * 8/1974 Chambers ..... F17C 13/06 137/382
4,961,514 A * 10/1990 Palmer ..... B65F 1/08 220/23.87
5,072,850 A * 12/1991 Gagnon ..... B65D 21/0233 215/332
2005/0089997 A1* 4/2005 Minton ..... C12M 23/10 435/288.3
2011/0174820 A1* 7/2011 Giles ..... B01L 3/508 220/315
2014/0162352 A1* 6/2014 Iskander ..... C12M 23/38 435/305.4
2018/0016067 A1 1/2018 Heim et al.
2018/0029863 A1 2/2018 French et al.

FOREIGN PATENT DOCUMENTS

EP 3 260 390 12/2017

* cited by examiner

*Primary Examiner* — James N Smalley
(74) *Attorney, Agent, or Firm* — Umberg Zipser LLP

(57) ABSTRACT

Various embodiments of containers are described having a base and a cap that is configured to couple with the base. The base includes a housing having a hollow interior, with the housing extending upwardly from an upper surface of the base. The base also includes a set of flexible tabs that are configured to flex when a force is applied. The housing has a set of outward projections, each of which is configured to be inserted into a recessed portion or notch of the cap when the cap is coupled with the base. The cap further includes a set of downward projections that contact the flexible tabs, such that a downward force applied to the cap causes the flexible tabs to flex downwardly, and the projections of the housing to move within the first and second recessed portions.

13 Claims, 5 Drawing Sheets

CHILD-RESISTANT CONTAINER

This application claim priority to U.S. provisional application filed on Nov. 14, 2017 having Ser. No. 62/586,098, and U.S. provisional application filed on Mar. 30, 2018 having Ser. No. 62/650,980. These and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is containers, and in particular, containers that are child-resistant.

BACKGROUND

The following description includes information that may be useful in understanding the present invention. It is not an admission that any of the information provided herein is prior art or relevant to the presently claimed invention, or that any publication specifically or implicitly referenced is prior art.

Child-resistant containers must meet certain regulatory guidelines. Traditional child resistance containers have a push down and turn style cap, where the container and cap are all made of plastic. However, such containers are not vapor and liquid-tight, and are utilitarian in design.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, there is still a need for improved child-resistance containers.

SUMMARY OF THE INVENTION

The inventive subject matter provides apparatus, systems and methods in which a container comprises a base, and a cap configured to couple with the base. In preferred embodiments, the base comprises an upward projection or cylindrical housing that has a hollow interior within which goods can be stored. When coupled with the base, the cap encloses the opening of the hollow interior and thereby secures any goods stored within.

In preferred embodiments, the cap is pushed toward the base and rotated to uncouple the cap from the base. It is contemplated the force required could be approximately four pounds. In this manner, the container can be child-resistant, and requires that a predetermined amount of force be applied during rotation to release the cap from the body/band.

In some embodiments, an insert can be provided comprising compressible foam with an optional layer of Teflon or similar material disposed on one side. The insert is preferably disposed within the container above the upward projection and below the cap's top portion. In such embodiments, when the cap engages with the base, the foam is compressed thereby sealing the hollow interior.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

FIGS. 1-8 illustrates one embodiment of a container 100 comprising a base 102 and a cap 120 configured to couple with the base 102. In preferred embodiments, the cap 120 must be pushed toward the base 102 and rotated to uncouple the cap 120 from the base 102. It is contemplated the force required should be sufficient to make the container resistant to children opening it, and meet the requirements under U.S. federal and states laws. In this manner, the container 100 requires a defined amount of downward force be applied during rotation to release the cap 120 from the base 102.

Figure 2:
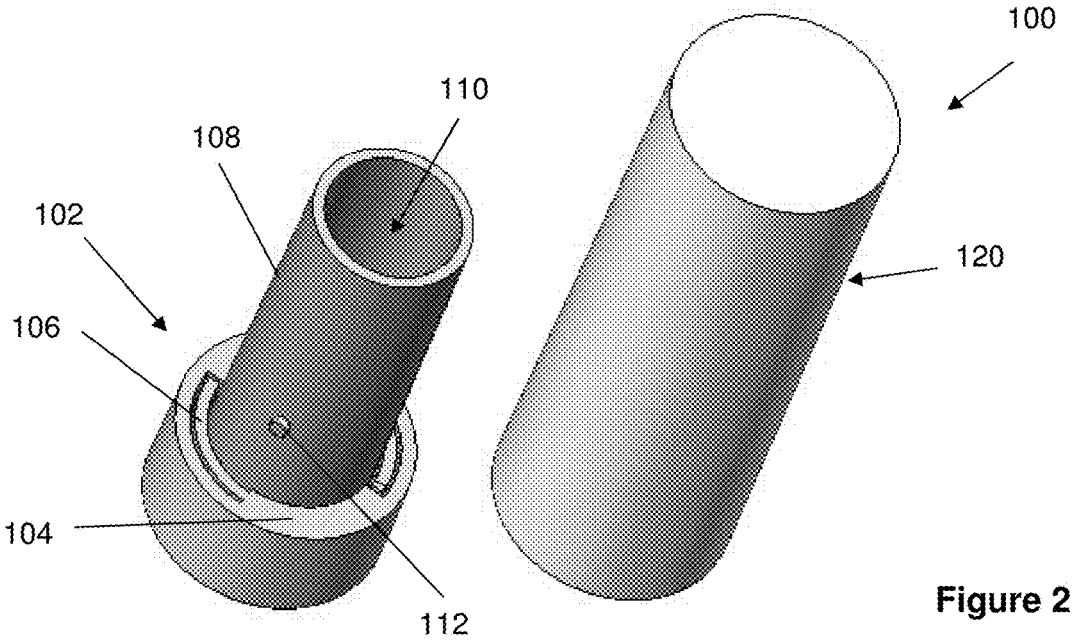
FIG. 2 illustrates a top, perspective view of the container of FIG. 1 where the cap is decoupled from the base.
Figure 3:
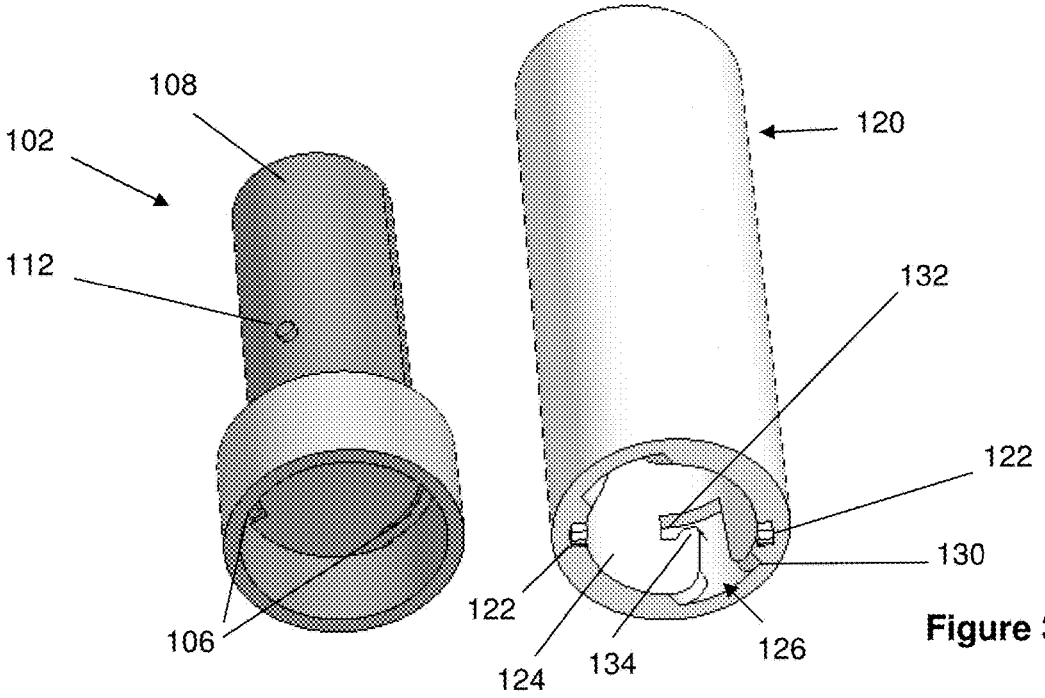
FIG. 3 illustrates a bottom, perspective view of the container of FIG. 1 where the cap is decoupled from the base.
Figure 4:
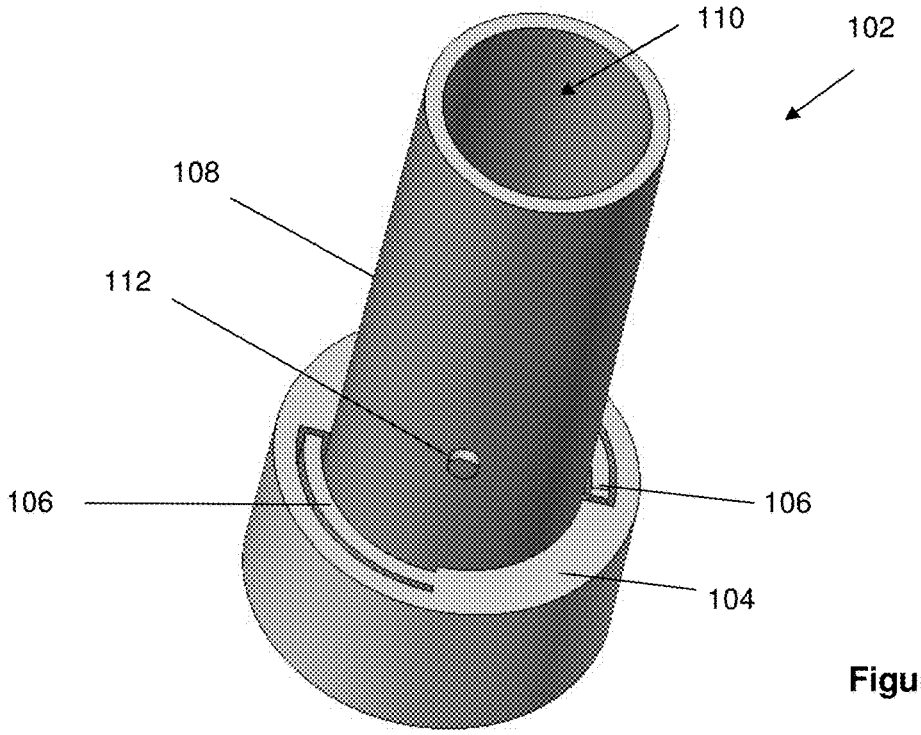
FIG. 4 illustrates a top, perspective view of the base of the container of FIG. 1.

Base 102 comprises an upper surface 104 having a set of flexible tabs 106, each of which is configured to flex downwardly when a force is applied and return to its initial state shown in FIG. 2 when the force is removed. As shown in the Figures, the base 102 can comprise two flexible tabs 106, although the specific number of tabs could vary without departing from the scope of the invention. Each of the tabs 106 is preferably attached to the upper surface 104 at a first end and is detached from the upper surface 104 at a second end.

Base 102 also comprises a housing 108 that projects upwardly from the upper surface 104. The housing 108 could comprise a cylinder or other shape, and preferably has a hollow interior 110 for storage of various articles or material(s). The top of housing 108 comprises an opening through which items can be placed within the hollow interior 110. In some embodiments, it is contemplated that the housing 108 can be removable coupled with the base 102; however, it is preferred that the housing 108 is integral with the base 102 such that they can be molded as a single piece during manufacture.

Although housing 108 is shown as terminating at the upper surface 104 of the base 102, it is alternatively contemplated that the housing 108 could extend below the upper surface 104 to increase the volume of the hollow interior 110 or reduce an overall height of the container 100.

As shown, it is preferred that a width or diameter of the housing 108 is less than a width or diameter of the base 102. While the container and various components are shown having a cylindrical shape, it is contemplated that other shapes could be used including a square-shaped cross-section and so forth.

Cap 120 is configured to engage with the body 102 to thereby cover the opening of the hollow interior 110. To couple the cap 120 with the body 102, the housing 108 preferably comprises at least first and second projections 112, which are each configured to be inserted into a recessed portion, path or notch 126 of an interior surface 124 of the cap 120, which extends to a bottom surface 128 of the cap 120. Although shown with curved outer edges 130, it is contemplated that that the edge could have planar or straight portions. The curved outer edges 130 create a tapered opening that encourages the projection 122 to be placed within the recessed portion or notch 126. Of course, it is alternatively contemplated that the housing 108 could comprise the recessed portion that receives a projection of the cap 120.

To couple the cap 120 with the base 102, the projections 112 are inserted into one of the recessed portions or notches 126 of the cap 120. To cause the projections 112 to move away from the bottom surface 128 of cap 120, the cap 120 is moved toward base 102. Each of the projections 122 of cap 120 may contact a flexible tab 106, which causes the tab 106 to flex downwardly (away from surface 104) and permits surface 128 of cap 120 to move toward surface 104 until the surface 128 and surface 104 contact one another. At this point, the cap 120 is rotated with respect to base 102, such that the projection 112 is moved toward the catch 132 of the recessed portion, path or notch 126, which is at least partially defined by peak 134. In this manner, the projection 112 has to move within the recessed portion or notch 126 and around peak 134 for the cap 120 to be secured or decoupled from the base 102.

Figure 5:
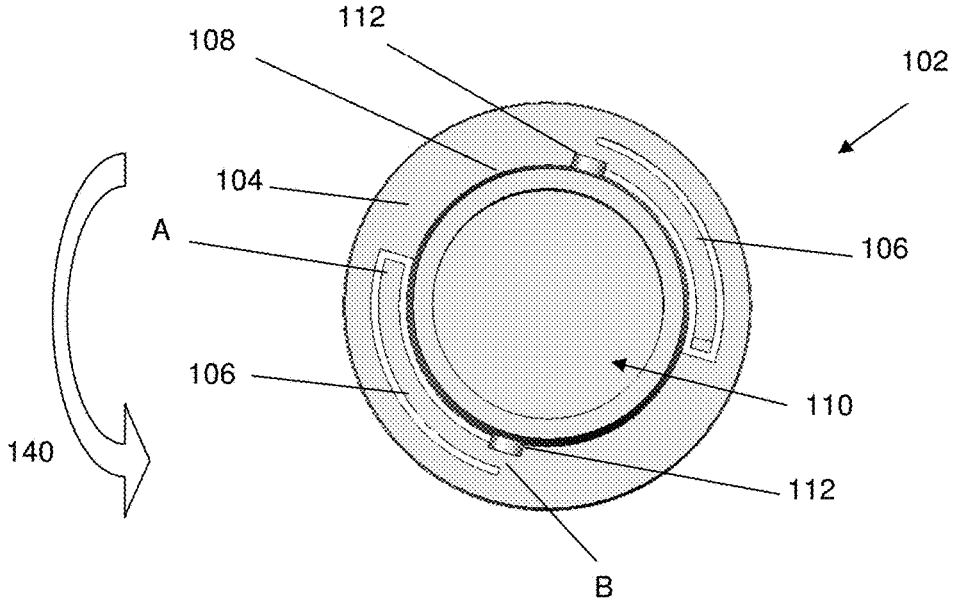
FIG. 5 illustrates a top view of the base of the container of FIG. 1.
Figure 6:
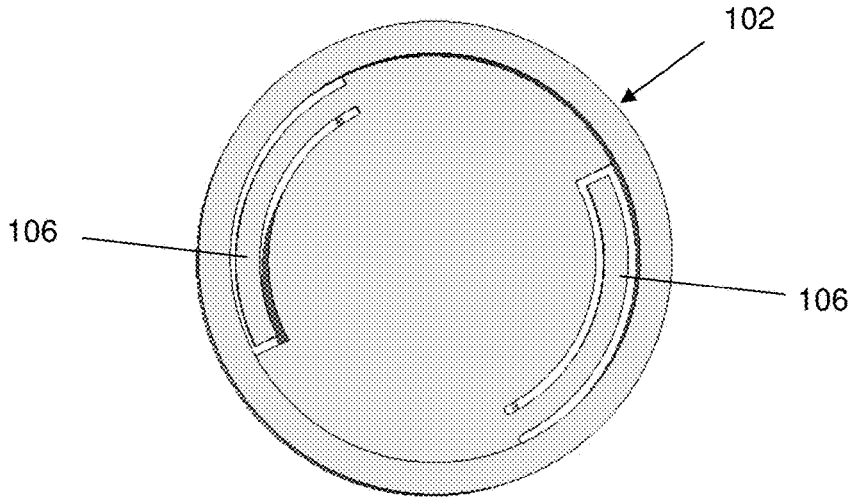
FIG. 6 illustrates a bottom view of the base of the container of FIG. 1.
Figure 7:
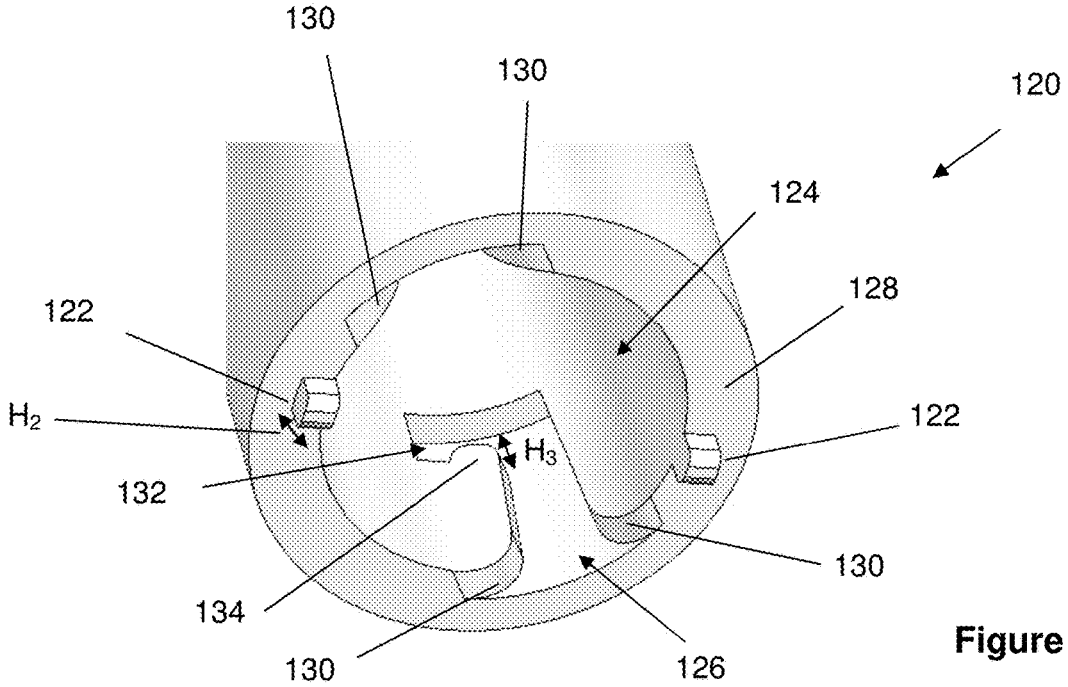
FIG. 7 illustrates an enlarged portion of the cap of the container of FIG. 1.

As the cap 120 is rotated in direction 140 shown in FIG. 5, the position of the cap's projection 122 moves with respect to the base 102 from position A to position B, such that when the projection 112 is at the catch 132, the cap's projection 122 is contacting or over the upper surface 104 of base 102 (i.e., at position B) and not flexible tab 106. In this manner, applying a downward force to the cap 120 will not cause the projection 112 to leave catch 132, unless such force is accompanied by a rotation of the cap 120 with respect to the base 102 in the opposite direction as that used to originally secure the cap 120 to the base 102 (opposition of direction 140). However, it is also contemplated that the projection 122 could rest above a portion of the tab 106 that is between position A and position B. Each projection 122 has a height $H_2$.

Preferably, to secure the cap 120 to the base 102, the cap 120 is rotated such that the projection 122 moves from a distal end (position A) of the flexible tab 106 toward the point at which the flexible tab 106 is coupled with the upper surface 104 (position B). As this occurs, the flexible tab 106 will naturally resist the downward force applied due to the decreased flexibility of the tab 106 as a function of a distance away from the tab's point of connection with surface 104.

Once the projection 112 is at the catch 132, the applied force to the base 102 or cap 120 can be released, which causes the flexible tab(s) 106 to move to their initial position and thereby positions the projection 112 within the catch 132. Thus, the flexibility of the tabs 106 must be sufficient to permit the projection 122 to move a distance below the upper surface 104 that is at least equal to a height $H_3$ of peak 134 as measured from a lower surface of the catch 132.

In some embodiments, each of the first and second recessed portions or paths 126 comprises a peak 134 about which the recessed portion 126 is disposed. A height $H_2$ of the projection(s) 122 is preferably the same or greater than a height $H_3$ of the peak 134, such that the flexible tabs 106 are needed to couple or remove the cap 120 from the base 102.

In other embodiments where a gap exists between the lower surface of the cap 120 and the upper surface of the base 102 when the cap 120 is coupled with the base 102, it is contemplated that each of the first and second recessed portions or paths 126 comprises a peak 134 about which the recessed portion 126 is disposed, and wherein a collective height of the projection and the space or gap ($H_1$+$H_2$) is the same or greater than a height of the peak $H_3$.

To disengage the cap 120 from the body 102, the opposite must occur. First, a downward force must be applied to the cap 120 as the cap 120 is rotated with respect to the base 102, to allow projections 112 to exit the catch 132 and pass by peak 134. Then, the downward force is released, and the cap 120 can be removed from the body 102.

In this manner, each of the recessed portions, paths or notches 126 acts as a lug having a J-shape and configured to receive one of the projections 112 of the housing 108, where each projection 112 extending outwardly from the housing 108. In this manner, each of the projections 112 can rest within one of the catches 132 when the cap 120 is engaged with the body 102.

Base 102 and cap 120 are preferably composed of plastic or other polycarbonate formed via an injection molding process. However, it is alternatively contemplated that other commercially suitable materials could be used.

In some embodiments, the container 100 can include an insert comprising compressible foam onto which an optional second layer of polytetrafluoroethylene such as Teflon™ may be attached. This dual layer insert can act to create a vapor-tight and liquid-tight seal when pressed against the top of the housing 108. Thus, in such embodiments, when cap 120 engages with body 102, the foam is compressed thereby sealing the hollow interior 110.

Figure 1:
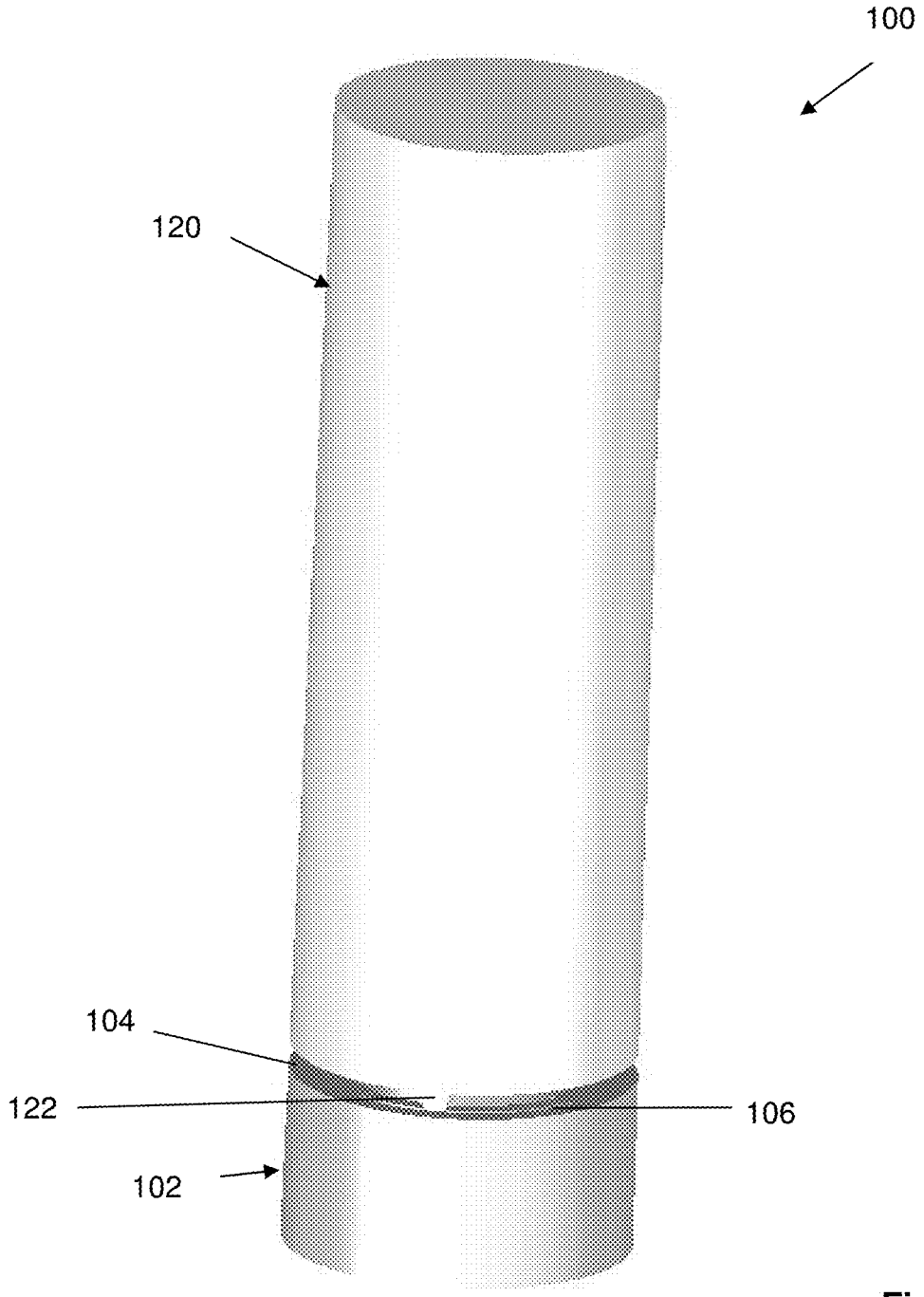
FIG. 1 illustrates a perspective view of one embodiment of a container.
Figure 8:
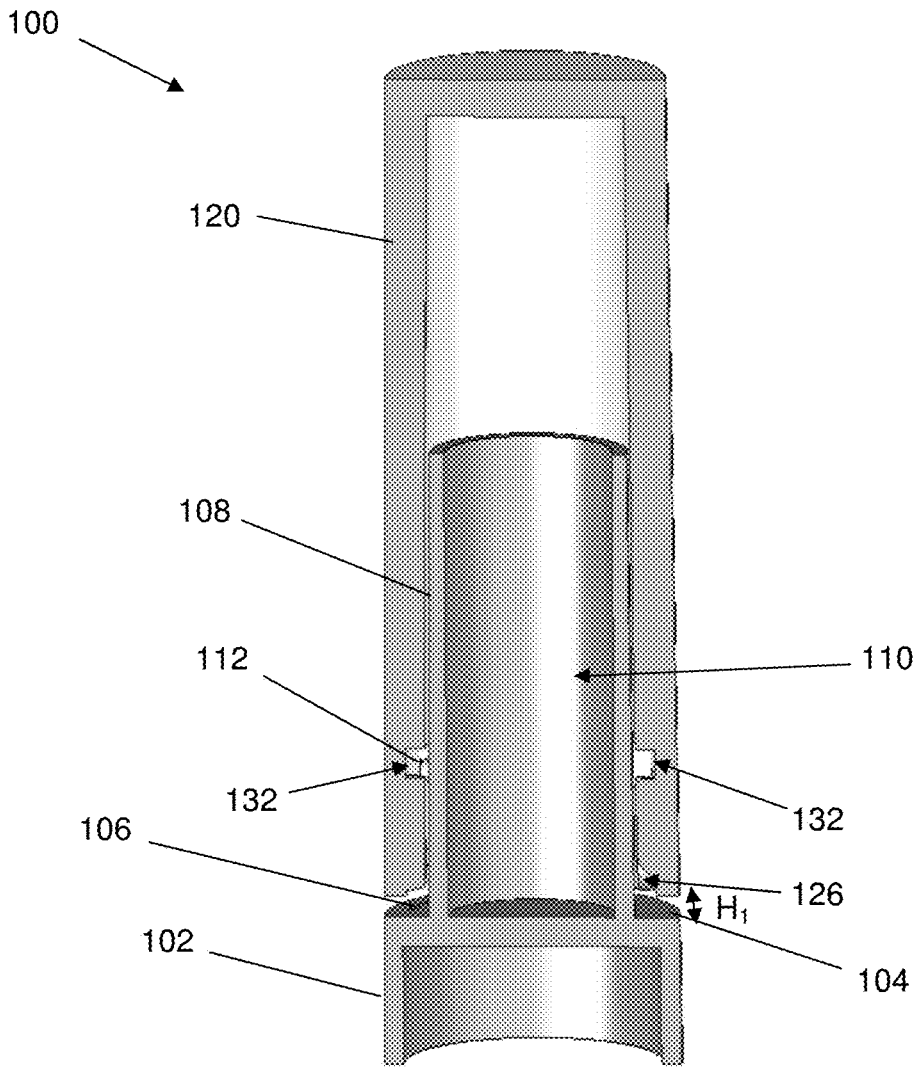
FIG. 8 illustrates a vertical, cross-section of the container of FIG. 1.

It is further contemplated that the cap 120 has a diameter or width that is equal to the diameter or width of base 102. A space or gap having a height $H_1$ can be formed between base 102 and the cap 120 when the cap 120 is engaged with the base 102, such as shown in FIGS. 1 and 8.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment.

In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A child-resistant container, comprising:

a base having an upper surface comprising at least two flexible tabs, each of which is configured to flex downwardly and away from the upper surface when a predefined amount of force is applied;

a housing coupled with the base such that the housing projects upwardly from the base, wherein the housing comprises a hollow interior with an opening at a first end opposite of the base, and wherein the housing comprises first and second projections;

a cap configured to couple with the base, and comprising first and second recessed portions or paths, each of which is configured to receive one of the first and second projections;

wherein a lower surface of the cap further comprises first and second projections that extend from the lower surface, and are configured to each contact one of the flexible tabs, such that a downward force applied to the cap causes the flexible tabs to flex downwardly; and wherein when the flexible tabs flex downwardly, the first and second projections of the housing move within the first and second recessed portions.

2. The container of claim 1, wherein each of the flexible tabs comprises a curved outer surface.

3. The container of claim 1, further comprising an insert composed of compressible foam.

4. The container of claim 3, wherein the insert further comprises a layer of polytetrafluoroethylene attached to the compressible foam.

5. The container of claim 1, wherein each of the first and second recessed portions comprises a J-shape.

6. The container of claim 5, wherein each of the first and second recessed portions comprises a catch configured to receive one of the first and second projections when the cap is coupled with the base, and wherein the catch is disposed at a first end of each of the first and second recessed portions away from the lower surface of the cap.

7. The container of claim 6, wherein each of the first and second recessed portions or paths comprises a peak about which the recessed portion is disposed, and wherein a height of the projection is the same or greater than a height of the peak.

8. The container of claim 1, wherein each of the first and second recessed portions or paths comprises a peak about which the recessed portion is disposed, and wherein a collective height of the projection and the space or gap is the same or greater than a height of the peak.

9. The container of claim 1, wherein the housing is integral with the base.

10. The container of claim 1, wherein the cap and base have an equal diameter or width.

11. The container of claim 1, wherein a space or gap is formed between the lower surface of the cap and the upper surface of the body when the cap is engaged with the body.

12. The container of claim 1, wherein the base, housing, and cap each comprises a cylindrical shape.

13. The container of claim 1, wherein the first and second downward projections contact the upper surface of the base or the flexible tabs when the cap is coupled with the base.

* * * * *